US005204148A

United States Patent [19]

Alexander et al.

[11] Patent Number: 5,204,148

[45] Date of Patent: Apr. 20, 1993

[54] LAMINATE COVER AND METHOD FOR SEALING A ROOFING MEMBRANE

[75] Inventors: Brian S. Alexander, Westfield; Daniel L. Barksdale, Brownsburg, both of Ind.

[73] Assignee: Bridgestone/Firestone, Inc., Akron, Ohio

[21] Appl. No.: 837,266

[22] Filed: Feb. 18, 1992

[51] Int. Cl.[5] ..... A61F 13/02

[52] U.S. Cl. ..... 428/40; 428/63; 428/64; 428/66; 428/141; 428/147; 428/192; 428/215; 428/220; 428/495; 428/519; 52/410; 52/514; 52/746

[58] Field of Search ..... 428/40, 63, 64, 141, 428/147, 192, 495, 66, 519, 215, 220; 52/410, 746, 514; 156/94, 71

[56] References Cited

U.S. PATENT DOCUMENTS

| | | | |
|---|---|---|---|
| 2,833,327 | 5/1958 | Boyce | 428/63 |
| 3,049,836 | 8/1962 | Weissman | 50/243 |
| 3,111,787 | 11/1963 | Chamberlain | 50/83 |
| 4,135,017 | 1/1979 | Hoffmann, Sr. | 428/78 |
| 4,358,495 | 11/1982 | Parker | 428/66 |
| 4,601,935 | 7/1986 | Metcalf | 428/141 |
| 4,602,971 | 7/1986 | Bergeron et al. | 156/94 |
| 4,620,402 | 11/1986 | Beneze | 52/410 |
| 4,657,958 | 4/1987 | Fieldhouse et al. | 524/247 |
| 4,732,635 | 3/1988 | Levens | 156/230 |
| 4,757,652 | 7/1988 | Kalkanoglu | 52/173 |
| 4,767,653 | 8/1988 | Renstrom | 428/40 |
| 4,852,323 | 8/1989 | Karrfalt | 52/410 |
| 4,885,887 | 12/1989 | Simmons | 52/746 |
| 4,936,071 | 6/1990 | Karrfalt | 52/420 |
| 4,972,638 | 11/1990 | Minter | 52/200 |
| 5,084,119 | 1/1992 | Barksdale | 156/157 |

*Primary Examiner*—Ellis P. Robinson
*Assistant Examiner*—Nasser Ahmad
*Attorney, Agent, or Firm*—Ernst H. Ruf

[57] ABSTRACT

A laminate cover for sealing an opening in a weatherproof roofing membrane includes a top sheet of a weather resistant material, preferably an uncured butyl rubber EPDM material, and a complementary shaped and sized lower sheet of a lightly cured butyl rubber having opposed tacky surfaces. A layer of a flowable sealing material such as an uncured butyl rubber sealing compound having a smaller dimension than that of the lower sheet, is trapped between the lower sheet and a bottom release coated carrier. Upon removal of the carrier, the cover is pressed over the opening to be sealed and an exposed peripheral tacky area of the lower sheet secures the cover to the membrane and traps the sealing compound therein. Applied or ambient heat will cause the sealing compound to flow into the opening to effectively seal the same, and will vulcanize the top sheet to provide abrasion and weather resistance for the cover.

11 Claims, 2 Drawing Sheets

LAMINATE COVER AND METHOD FOR SEALING A ROOFING MEMBRANE

BACKGROUND OF THE INVENTION

1. Technical Field

The invention relates to a cover for sealing an opening in a weatherproof roofing membrane. More particularly, the invention relates to a cover and to the method of applying it over a mechanical fastener or T-joint of a weatherproof roofing membrane to seal an opening therein.

2. Background Information

A large number of commercial and factory plant roofs are of a flat roof design wherein the roofing material itself is often of a built up asphalt, and in more modern systems is a single ply of an elastomeric sheet material or membrane, acrylic, or similar weatherproof sheeting, which utilizes a mechanical ballast system or layer of stone over the membrane. While the ballast system is preferable for certain installations, it has a disadvantage of being heavier and is not suitable for steeper roof slopes.

Other membrane systems use mechanical fasteners which require fixation of components to the roofing substrate via mechanical fasteners. There are two basic kinds of mechanical fastening systems, namely membrane penetrating and non penetrating types. Each of these types of systems has a number of favorable features, and each of them is subject to various drawbacks and disadvantages. One type of non penetrating roof membrane fastening system is shown in U.S. Pat. No. 4,852,323. A penetrating type of fastening system is shown in U.S. Pat. No. 4,620,402. One disadvantage with the penetrating type fastening system is that the membrane is pierced providing a possible area of water leakage.

In the installation of membrane roof coverings, the membrane is unrolled in relatively large sheets of the weatherproof membrane which may have widths of 6, 8, 10 feet or more and lengths of up to 100 feet. These sheets when laid out over a roof deck are spliced together to form a continuous roofing sheet. The linear seams are formed by lap joints or butt joints and are spliced to adjacent sheets where the edges are abutted or overlapped. In certain applications, a third sheet may overlap the joint of the other two sheets and form a T-joint, which due to the unevenness of the lapped joint provides a possible opening through which water could seep to the lower roof deck.

It is desirable that a cover or patch be provided for these T-joint areas as well as for the penetrating mechanical fasteners for certain roof membrane covering systems. Typical membranes for such installations are formed of reinforced or nonreinforced EPDM (ethylene propylene diene copolymer) or neoprene, and certain acrylics or plastic materials.

Various types of sealing tapes have been devised to seal the seam between adjacent roofing membranes. A known two layer sealing tape construction consists of an upper layer containing vulcanized EPDM and reinforced resin, in combination with a lower layer of sealing tape material. However, these prior art sealing tapes do not for certain applications provide the desired sealing affect which can in turn cause leaks in the openings in the roof membranes provided by the T-joints and mechanical penetrating fasteners.

Various other types of covers or patches also have been devised for various types of sealing applications, known examples of which are set forth in the following patents.

U.S. Pat. No. 3,049,836 discloses a roof repair patch comprising a shallow inverted pan-like shell containing a mastic composition in the upper portion of the shell and a membrane underlying the mastic composition.

U.S. Pat. No. 3,111,787 shows a roofing element consisting of a top layer of felt and adhesive, and a release paper for attachment to a plywood roof deck.

U.S. Pat. No. 4,135,017 discloses a laminated patch for repairing a hole in a surface of an interior wall. A rigid plate of aluminum is covered with an adhesive on one side for bonding it to the wall surface, which adhesive is initially protected by a release film.

U.S. Pat. No. 4,358,495 discloses a dry wall patch kit consisting of a pair of disc shaped members, one of which is larger than the other to provide a peripheral bonding area.

U.S. Pat. No. 4,437,283 discloses a sealing tape having an adhesive on both sides, in combination with a cover member formed of the same material as the roofing member, such as EPDM. The tape also has a removable adhesive release liner, and due to the double sided adhesive, adheres to both the roof membrane as well as to the covering membrane to provide a seal therefore.

U.S. Pat. No. 4,602,971 shows a patch consisting of a carrier layer having an outer circular patch layer secured thereto by an adhesive. An inner circular barrier layer which is free of any adhesive is located within the surrounding adhesive layer.

U.S. Pat. No. 4,657,958 discloses one type of an adhesive composition for bonding sheets of EPDM elastomeric roofing membranes to each other on a roofing system.

U.S. Pat. No. 4,732,635 discloses a method of making spliceable sheet material in which polyethylene film is adhered to one border of a cured EPDM member having an adhesive with a protectable removable liner, which when assembled is subjected to heat and pressure to cure the compound and bond the heat sealable adhesive to the adjacent membrane.

U.S. Pat. No. 4,757,652 discloses a type of shingle having release sheets on edge portions of the underlying surfaces thereof whereby the bitumen material of the shingle will adhere to adjacent shingles after removal of the release sheet.

U.S. Pat. No. 4,767,653 discloses a heat sealable sheet material for use in the formation of lap seam membranes in which polyethylene film is adhered to the border of the cured EPDM material. The resulting assembly then is subjected to heat and pressure to cure the compound and bond the membrane to the heat sealable adhesive.

U.S. Pat. No. 4,855,172 shows a laminate system consisting of a cover strip having an adhesive layer applied to a strip of the roofing membrane material in combination with a fastening bar.

U.S. Pat. No. 4,936,071 discloses a seaming tape for metal roofing which also can be used as a patch. This cover consists of a top layer of EPDM and a bottom layer of butyl rubber which enables the top layer of EPDM to be firmly secured to the bottom layer due to the natural tackiness of the bottom layer. A protective release sheet or silicone treated paper also is provided to protect the tacky layer until ready for use.

U.S. Pat. No. 4,972,638 shows an EPDM flashing used for sealing skylight windows, which is provided with an adhesive on one side.

Although a number of the above discussed prior art sealing tapes and patches are effective for their intended installation, they may not be suitable for the exposure to which the cover of the present invention is subjected to when used on an exposed roofing membrane. In such an environment the cover is subjected to wide ambient changes in temperature and to physical and chemical abrasion, and to harmful ultraviolet rays, due to the environment in which it is utilized. Furthermore such prior art covers do not provide the desired flowability so that the sealing material can flow into openings to provide an effective seal therefore without requiring time consuming installation procedures and additional material components.

SUMMARY OF THE INVENTION

Objectives of the invention include providing an improved laminate cover or patch for sealing an opening in a roofing membrane, preferably over a roof membrane penetrating mechanical fastener, and to cover a T-joint formed at the intersection of three roofing membranes.

A still further objective of the invention is to provide such a laminate cover having a top sheet of a weather resistant flexible material or a membrane of an uncured EPDM elastomeric material or other material which will stretch and deform during installation to conform to the joint or fastener being covered, and for certain materials will eventually cure after installation over a period of time due to the ambient temperature and sun exposure, to provide weather and abrasion resistance for the cover.

Another objective of the invention is to provide such a laminate cover having a bottom sheet of a material having sufficient tackiness to secure the top sheet thereto and to secure the cover to a roof membrane when pressed thereagainst.

A further objective of the invention is to provide such a laminate cover containing a layer of uncured butyl rubber compound or similar material which is flowable when subjected to heat, which layer is of a smaller size than the adjacent lightly cured sheet of material so as to be trapped in the applied area by the surrounding peripheral area of the cured sheet; and in which the heat flowable butyl rubber compound or similar flowable material is retained in position adjacent the cured sheet by a release coated carrier which is removed just prior to applying the cover to an opening in the roofing membrane.

A still further objective of the invention is to provide such a laminate cover in which the top sheet provides weather and abrasion resistance for the cover and is flexible so that it conforms to the covered joint or fastener and is complementary in shape and size to the adjacent cured elastomeric tacky sheet whereby the edges of the two strips and the release carrier are flush, enabling the laminate cover to be die cut from a larger sheet to obtain a desired dimension; and in which the cover preferably is disc shaped.

These objectives and advantages are obtained by the improved laminate cover of the invention, the general nature of which may be stated as a laminate cover for sealing a roofing membrane including a release coated carrier having a peripheral border; a layer of uncured elastomeric sealing material located within the peripheral border of the carrier adapted to be positioned in contact with an area of a roofing membrane to be sealed thereby after removal of the carrier from said layer of sealing material; a first sheet of elastomeric material mounted on the carrier and having a peripheral border greater than the layer of sealing material in order to trap said layer after said layer of sealing material has been placed in contact with the roofing membrane; and a second sheet of weather resistant material secured to the first sheet to provide physical protection to said first sheet and to said layer of sealing material.

These objectives and advantages are further obtained by the improved method of the invention, the general nature of which may be stated as a method for sealing an opening in a weatherproof roofing membrane which includes the steps of providing a cover member having an underside with an exposed pressure sensitive tacky peripheral area and an inner area formed of a soft pliable flowable uncured butyl rubber compound; positioning the inner area of the cover member over the opening in the membrane; pressing the tacky peripheral area of the cover membrane against the membrane to trap the uncured butyl rubber compound within said peripheral area; and permitting the uncured butyl rubber compound to flow into the opening in the membrane to seal said opening when heated.

BRIEF DESCRIPTION OF THE DRAWINGS

A preferred embodiment of the invention, illustrative of the best mode in which applicants have contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 2:
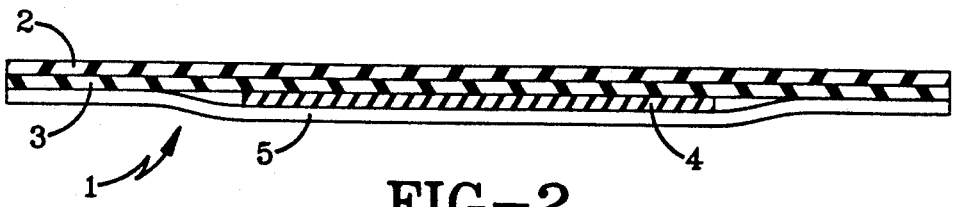
FIG. 2 is a sectional view taken on line 2—2, FIG. 1.
Figure 1:
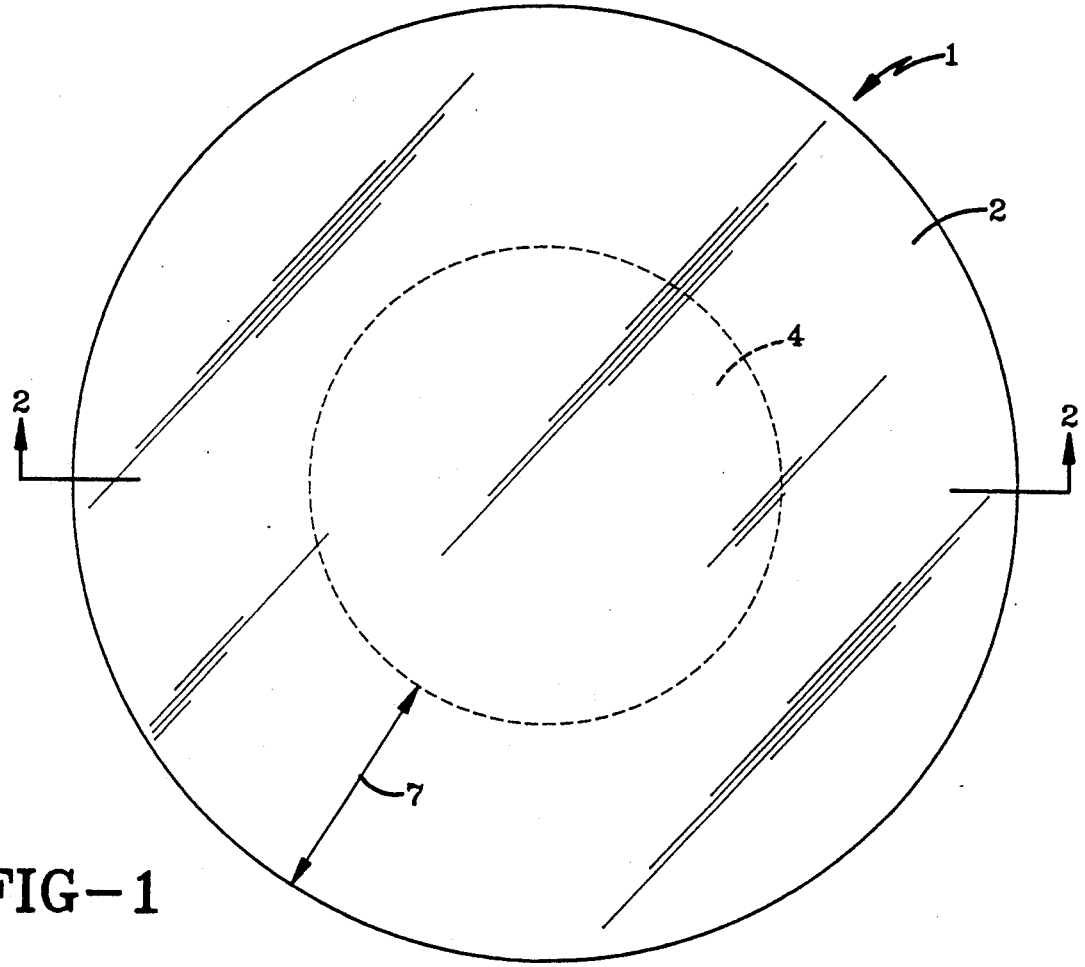
FIG. 1 is a top plan view of the improved laminate cover of the invention.

The laminate cover of the present invention is indicated generally at 1, and is shown particularly in FIGS. 1 and 2. Cover 1 includes a top sheet 2 and a second or bottom sheet 3, and a layer of uncured elastomeric sealant material 4 retained by a bottom release coated carrier 5. Laminate cover 1 preferably is disc-shaped as shown particularly in FIG. 1, but could be rectangular or have other shapes without affecting the concept of the invention. However the disc-shaped configuration is preferred for most sealing applications of the type with which cover 1 is intended to be used as described in greater detail below.

In the preferred embodiment, sheets 2 and 3 and carrier 5 will have a diameter of six inches with the peripheral edges thereof being flush. This enables the covers to be die cut from larger sheets in an economical production technique when forming a plurality of the covers.

Figure 4:
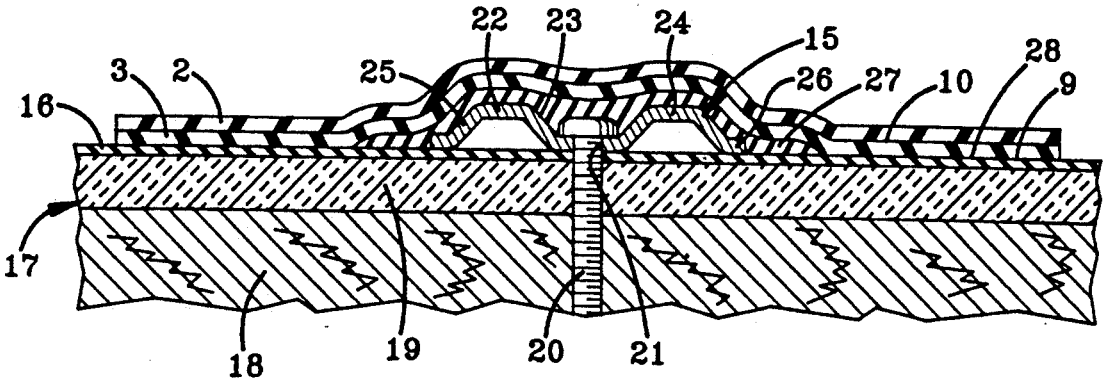
FIG. 4 is a sectional view of the laminate cover of the invention when applied over the mechanical fastener of FIG. 3.

Sealant layer 4 preferably is disc-shaped as shown by the dotted lines in FIGS. 1 and 4 but will be of a smaller diameter than that of bottom sheet 3 so as to lie within the periphery thereof so as to form an annular border 7 thereabout. In the preferred embodiment, sealant layer 4 will have a diameter of approximately three inches providing annular border 7 with an inch and a half dimension. Carrier 5 is of a usual construction such as silicone coated Kraft paper or the like, which will readily release from a pressure sensitive adhesive, and in particular from the tacky bottom surface 9 of sheet 3.

Top sheet 2 is formed of a weather resistant material such as an acrylic or other type of plastic, and in the preferred embodiment is formed of an unvulcanized unreinforced self-curing EPDM butyl rubber compound of the type manufactured and sold by Bridgestone/Firestone, Inc. under its trademark FORM-FLASH and preferably has a thickness of between 0.025 and 0.040 inches. Bottom sheet 3 preferably is formed of an unreinforced elastomeric tacky butyl rubber compound. Sheet 3 will have been lightly cured so as to provide a dimensionally stable, tacky sheet, which due to its tackiness, its top surface 10 will readily adhere to top sheet 2, and its bottom surface 9 to a roofing membrane 16 and/or a mechanical fastener 15 to which it is subsequently applied.

Sealant layer 4 may be similar to sheet 3 except that it does not have a cure additive so that it will flow at high temperatures and it has an extremely low modulus. In the preferred embodiment, sealant 4 will be a soft pliable material and relatively stable prior to use, but will readily fluidize and flow out when applied to a roofing membrane and subsequently heated either ambiently or by an applied heat. Preferred flowable sealant adhesive resin composition comprise butyl rubber copolymers including halogen butyl rubbers where the butyl rubbers are copolymers of an isoolefin with minor amounts of conjugated diolefin, such as isobutylene copolymerized with 0.5 percent to 5 percent isoprene. Suitable flowable sealant adhesives contain isobutylene copolymerized with 0.5 percent to 30 percent by weight of an open chain diolefin such as isoprene; 1,3-butadiene, piperylene; 2,3-dimethyl-1,3-butadiene; 1,2-dimethyl-1,3-butadiene; 1,3-dimethyl-1,3-butadiene; 1-ethyl butadiene-1,3 (hexadiene-1,3); and 1,4-dimethyl butadiene-1, 3-butadiene (hexadiene-2,4), as more particularly disclosed in U.S. Pat. Nos. 4,588,637 and 4,855,172, and hereby fully incorporated by reference.

Useful polyisobutyl rubber copolymers have a molecular weight between 10,000 and 100,000, although the preferred molecular weight range is from about 10,000 to 15,000 with a most preferred molecular weight range being between about 10,000 and 11,000. Alternatively, the butyl rubber copolymers can have molecular weights above 100,000 if a crosslinkable butyl rubber is compounded with softening agents or solvents and without a curing system. The butyl rubber copolymer ordinarily is intermixed with conventional or desirable additives such as a tackifier, pigment, oxidizer, inert filler, or a softener to form the flowable sealant layer 4. Useful tackifiers include thermoplastic olefins, isoparafins, terpene polymers, and methyl styrene copolymers as disclosed in U.S. Pat. No. 4,113,799. Useful oxidizing agents include organic peroxides where benzoyl peroxide is preferred. Pigments include carbon black and titanium dioxide or other opacifying pigments, while mineral reinforcing fillers can include zinc oxide, aluminum hydrate, lithophone, clays, hydrated silicas, calcium silicate, magnesium oxide, magnesium carbonate and similar reinforcing agents. A crosslinking agent is not used. Useful levels of carbon black are between about 3 percent to 15 percent, while useful levels of silica are between about 1 percent to 5 percent based on the weight of polymeric resin.

The flowable adhesive sealant layer 4 described above or other flowable materials, can be slightly flowable, but are otherwise relatively stable at room temperature. With increases in temperature and/or pressure, sealant layer 4 increases in flowability and decreases in viscosity whereby application under heat and pressure causes sealant layer 4 to flow freely into linear seams and other gaps, crevices and openings proximate to or in the membrane to be sealed. Minor amounts of pressure of about 10 to 20 pounds and preferably about 15 pounds per square inch, more or less, can be applied by a hand-held roller if desired, while useful application temperatures are between about 0° C. and about 90° C. at the membrane.

In the preferred embodiment, sheet 3 comprise a high strength dimensionally stable elastomeric rubber having a thickness within the range of from 0.025 inches to 0.040 inches. Preferred elastomeric sheet 3 comprises partially or lightly crosslinked tacky carbon black reinforced seaming compound containing a polymeric blend of butyl rubber and polyisobutylene, as more particularly disclosed in U.S. Pat. No. 4,601,935 and hereby fully incorporated by reference. The butyl rubber and polyisobutylene polymeric blend can contain from about 40 percent to 60 percent by weight copolymerized isobutylene and can be mixed with conventional or desirable additives such as carbon black, plasticizers, pigments, tackifiers, softeners, and a low temperature curing agent such as a p-quinone dioxime.

Figure 3:
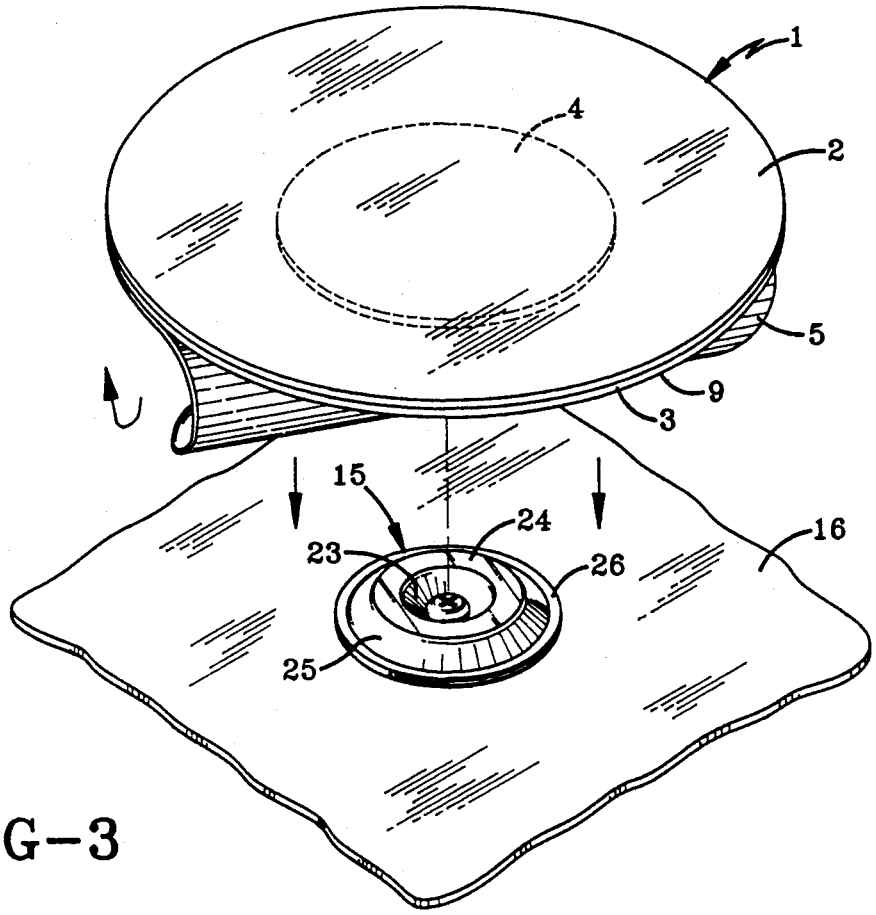
FIG. 3 is an exploded perspective view showing the improved laminate cover of FIGS. 1 and 2 just prior to installation over a mechanical roof membrane fastener.
Figure 5:
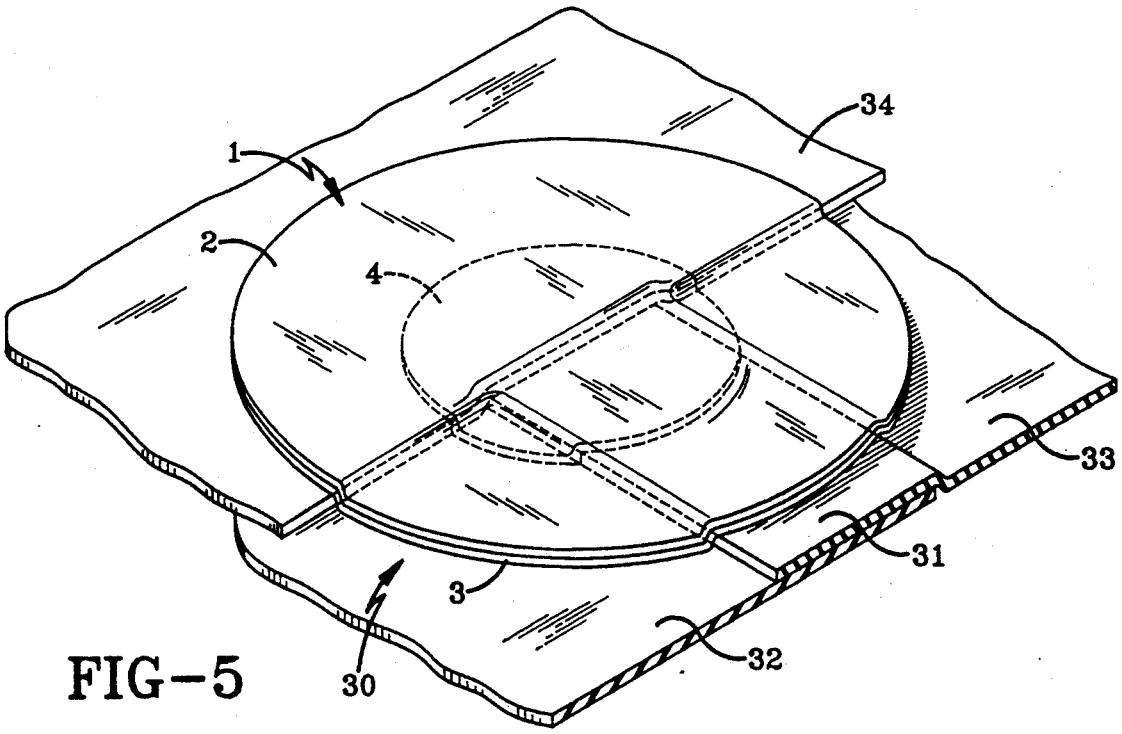
FIG. 5 is a perspective view of the laminate cover applied as a T-joint cover or patch.

The preferred method of using laminate cover 1 is shown particularly in FIGS. 3–5. In FIGS. 3–4, cover 1 is used to seal mechanical roof fastener 15. Fastener 15 is shown securing elastomeric membrane 16 onto a roof 17 of the type which consists of a roof deck 18 covered by an insulation sheet 19. An attachment screw 20 extends through a central opening 21 formed in an attachment washer 22 at a recessed central area 23 in which the head of the screw is located. Washer 22 has a raised annular central portion 24 and a conical shaped outer portion 25 terminating in annular end flange 26.

Mechanical fastener 15 and an annular area thereabout is first cleaned to remove any foreign contaminants. Next the area will be covered with a splice adhesive or other primer commonly used in the roof covering industry, which will not only aid the adhesion of cover 1 thereto, but will also act a waterproofing safeguard. After the splice adhesive or primer has had ample drying time, carrier 5 is removed from bottom sheet 3 and then centered over the mechanical fastener and then pressed downwardly thereagainst. For a usual type of installation, washer 22 will have a diameter of approximately 2 inches, whereby sealant layer 4 will flow into recessed central area 23 and along conical sidewall 25 and beyond annular end flange 26 to cover an adjacent annular area 27 of membrane 16. The outer annular border 7 of bottom sheet 3 will adhere to an annular area 28 which surrounds sealant layer 4 for adhering sheets 2 and 3 to roof membrane 16. Applying downward pressure to the cover will force any air out from between sealant layer 4 and washer 22, and due to the flowable nature of sealant 4, it will sag and flow into central area 23 and about the head of screw 20 to completely seal the same. It also will flow around the outer peripheral edges of washer end flange 26 to completely seal the washer from the intrusion of water seepage. Sealant 4 is prevented from flowing away from the intended area to be sealed, by cured bottom sheet 3 which is firmly sealed to membrane 16 completely about sealant layer 4.

Uncured top sheet 3 will ultimately be cured by the ambient temperatures caused by the sun or could be cured quicker by applied heat, which then provides the desired abrasion, weather, sunlight and chemical resistance for bottom sheet 3 and trapped sealant layer 4. Sealant 4, in addition to sealing the fastener will also assist in securing screw 20 in position with washer 22, preventing it from backing out of the roof deck after it has been fastened thereto.

FIG. 5 shows a usual T-joint indicated generally at 30, at which joint cover 1 is intended to be installed to prevent any water from seeping between the uneven areas caused by the lap joint 31 of adjacent membranes 32 and 33 and an overlying membrane 34. Cover 1 is applied in the same basic manner as discussed above with respect to mechanical fastener 15, with sealant layer 4 overlapping the area shown by the dotted lines in FIG. 5. Layer 4 will provide sufficient sealing for most T-joints, since a lapped seam joint will be approximately two inches in length and in the preferred embodiment, layer 4 will have a three inch diameter. Again, the flowable nature of sealant layer 4 will enable it to move into any open areas formed by the uneven surfaces of lapped joint 31 at the location of its crossing by top membrane 34. Again, the areas overwhich cover 1 is to be installed will be initially cleaned and then coated with the splice adhesive or primer as discussed above.

Accordingly, the laminate cover is simplified, provides an effective, safe, inexpensive, and efficient device which achieves all the enumerated objectives, provides for eliminating difficulties encountered with prior covers and patches, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved laminate cover is constructed and used, the characteristics of the construction, and the advantageous, new and useful results obtained; the new and useful structures, devices, elements, arrangements, parts and combinations, and method steps, are set forth in the appended claims.

We claim:

1. A flexible laminate cover for sealing a roofing membrane including:

a) a release coated carrier having a peripheral border;

b) a layer of uncured elastomeric sealing material located within the peripheral border of the carrier adapted to be positioned in contact with an area of a roofing membrane to be sealed thereby after removal of the carrier from said layer of sealing material;

c) a first sheet of a dimensionally stable tacky elastomeric material mounted on the carrier and having an exposed pressure sensitive peripheral border extending beyond the layer of sealing material in order to adhere to the roofing membrane after the release coated carrier has been removed form the first sheet and sealing material, and to trap said layer of sealing material within the peripheral border of said first sheet after said first sheet and sealing material have been placed in contact with the roofing membrane; and d) a second flexible sheet of a weather resistant material permanently secured to the first sheet to provide physical protection to said first sheet and to said layer of sealing material after said first sheet and said sealing member have been placed in contact with the roofing membrane.

2. The laminate cover defined in claim 1 in which the layer of sealing material is a soft pliable uncured butyl rubber compound adapted to flow into open areas of the roofing membrane upon heat being applied to the cover.

3. The laminate cover defined in claim 1 in which the first sheet is a lightly cured tacky butyl rubber compound.

4. The laminate cover defined in claim 1 in which the first sheet is formed of unreinforced EPDM.

5. The laminate cover defined in claim 1 in which the second sheet is an uncured dimensionally stable butyl rubber compound.

6. The laminate cover defined in claim 1 in which the second sheet is formed of unreinforced EPDM.

7. The laminate cover defined in claim 1 in which the cover is disc-shaped; and in which the first and second sheets and the carrier, each have a diameter of approximately six inches.

8. The laminate cover defined in claim 7 in which the layer of sealing material has a diameter of approximately three inches.

9. The laminate cover defined in claim 1 in which the first and second sheets have a thickness within the range of from 0.025 inches to 0.040 inches.

10. The laminate cover defined in claim 1 in which the sealing layer is formed of a non crosslinked butyl rubber compound having a molecular weight from about 10,000 to about 100,000.

11. The laminate cover defined in claim 1 in which peripheral edges of the carrier and of the first and second sheets are flush to each other.

* * * * *

UNITED STATES PATENT AND TRADEMARK OFFICE

CERTIFICATE OF CORRECTION

PATENT NO. : 5,204,148

DATED : April 20, 1993

INVENTOR(S) : Brian S. Alexander, et al.

It is certified that error appears in the above-identified patent and that said Letters Patent is hereby corrected as shown below:

Column 8, claim 1, line 16, "form", should read --from--.

Signed and Sealed this

Thirtieth Day of November, 1993

*Attest:*

*Attesting Officer*

BRUCE LEHMAN

*Commissioner of Patents and Trademarks*